US011805888B2

(12) United States Patent
McDermott et al.

(10) Patent No.: US 11,805,888 B2
(45) Date of Patent: Nov. 7, 2023

(54) INFLATABLE HAMMOCK

(71) Applicants: Scott D. McDermott, Cottonwood Heights, UT (US); Robert D. McDermott, Sandy, UT (US)

(72) Inventors: Scott D. McDermott, Cottonwood Heights, UT (US); Robert D. McDermott, Sandy, UT (US)

( * ) Notice: Subject to any disclaimer, the term of this patent is extended or adjusted under 35 U.S.C. 154(b) by 140 days.

(21) Appl. No.: 17/241,901

(22) Filed: Apr. 27, 2021

(65) Prior Publication Data

US 2021/0244162 A1 Aug. 12, 2021

Related U.S. Application Data

(63) Continuation-in-part of application No. 16/143,394, filed on Sep. 26, 2018, now Pat. No. 11,213,112.

(60) Provisional application No. 62/561,191, filed on Sep. 20, 2017.

(51) Int. Cl.

| | |
|---|---|
| ***A45F 4/00*** | (2006.01) |
| ***A47C 27/08*** | (2006.01) |
| ***A45F 3/22*** | (2006.01) |
| ***A45F 3/00*** | (2006.01) |

(52) U.S. Cl.

CPC ..... *A45F 4/00* (2013.01); *A45F 3/22* (2013.01); *A47C 27/081* (2013.01); *A45F 2003/001* (2013.01); *A45F 2003/003* (2013.01)

(58) Field of Classification Search

CPC ..... A45F 4/00; A45F 3/22; A45F 3/24; A45F 3/26; A45F 3/00; A45F 2003/003; A45F 2003/001; A45F 3/02; A47C 27/081; A47G 9/086

See application file for complete search history.

(56) References Cited

U.S. PATENT DOCUMENTS

| | | | |
|---|---|---|---|
| 2,284,900 | A | 6/1942 | Henderson et al. |
| 2,321,966 | A | 6/1943 | Andersson |
| 5,072,465 | A | 12/1991 | Lyons, Jr. |
| 5,115,525 | A | 5/1992 | Lovitt |
| 5,186,667 | A | 2/1993 | Wang |
| 5,265,293 | A | 11/1993 | Spahn |
| 5,560,056 | A | 10/1996 | Tai |
| 5,669,182 | A | 9/1997 | Griffis |
| 6,715,168 | B2 | 4/2004 | Williams |

(Continued)

FOREIGN PATENT DOCUMENTS

| | | | |
|---|---|---|---|
| CN | 201888419 | | 7/2011 |
| CN | 201888419 U | * | 7/2011 |

OTHER PUBLICATIONS

Examiner Interview Summary Record received for U.S. Appl. No. 16/143,394, dated Apr. 19, 2021, 3 pages.

(Continued)

*Primary Examiner* — Justin C Mikowski
*Assistant Examiner* — Madison Emanski
(74) *Attorney, Agent, or Firm* — Workman Nydegger

(57) ABSTRACT

An inflatable hammock comprises a panel that has an air containing region and a bonded region. A plurality of tension members attached on both ends of the panel and having free ends that are configured to suspend the panel. An exemplary inflatable hammock may convert between a first configuration for use as a hammock and a second configuration as a sleeping pad as described herein.

17 Claims, 11 Drawing Sheets

(56) References Cited

U.S. PATENT DOCUMENTS

| | | | | |
|---|---|---|---|---|
| 6,948,206 | B1 | 9/2005 | Valencia | |
| 8,745,782 | B2 | 6/2014 | Bernat | |
| 8,893,328 | B1 * | 11/2014 | Kroeger ..... | A47G 9/086 5/120 |
| 2016/0007763 | A1 | 1/2016 | Alder et al. | |
| 2016/0213128 | A1 | 7/2016 | Maxfield et al. | |
| 2016/0213130 | A1 | 7/2016 | Frazer et al. | |
| 2016/0316897 | A1 | 11/2016 | Pancy et al. | |
| 2019/0090618 | A1 | 3/2019 | Mcdermott et al. | |

OTHER PUBLICATIONS

Non-Final Rejection dated May 25, 2021 for U.S. Appl. No. 16/143,394.
Notice of Allowance received for U.S. Appl. No. 16/143,394, dated Sep. 9, 2021, 9 pages.
Office Action Appendix received for U.S. Appl. No. 16/143,394, dated Apr. 19, 2021, 2 pages.
Restriction Requirement for U.S. Appl. No. 16/143,394 dated Sep. 8, 2020.
Non-final Office Action for U.S. Appl. No. 16/143,394 dated Oct. 30, 2020.
Final Office Action for U.S. Appl. No. 16/143,394 dated Jan. 19, 2021.
Non-final Office Action for U.S. Appl. No. 16/143,394 dated May 25, 2021.

* cited by examiner

INFLATABLE HAMMOCK

CROSS-REFERENCE TO RELATED APPLICATIONS

This is a continuation in part application of U.S. patent application Ser. No. 16/143,394, filed Sep. 26, 2018, and entitled Inflatable Hammock, which claims priority to and the benefit of U.S. Provisional Application No. 62/561,191, filed Sep. 26, 2017. The entire content of each of the foregoing patent applications is incorporated herein by reference.

BACKGROUND

Hammocks are widely used for leisure and relaxation. While spending time away from the convenience of modern amenities, hammocks allow people to engage with nature and yet still enjoy a level of comfort or protection from weather and other factors. They generally include a panel made of fabric or netting that is suspended between two points, such as a vertical post or tree. They also come in a variety of different shapes and sizes. For example, some hammocks can be made to function as a bed or tent for camping trips or other sleeping arrangements. Also, some hammocks are collapsible for ease in portability and storage. To further the use and functionality of hammocks, improvements and enhancements of hammocks are desirable.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

The following relates to hammocks, particularly inflatable hammocks, and inflatable hammocks that can be used as an inflatable hammock, a sleeping pad, and a chair.

An inflatable hammock comprises a panel that has a plurality or network of fluid interconnected inflatable cells or regions. A plurality of tension members attached on both ends of the panel and having free ends are configured to suspend the panel.

A convertible inflatable hammock comprises a panel with a plurality or network of fluid interconnected inflatable cells or regions. Tension members on both ends of the panel have free ends that are configured to suspend the panel. In one configuration, the hammock is configured for use as a hammock when the panel is supported by the plurality of tension members on both ends of the panel. In another configuration, the hammock is configured for use as a sleeping pad when the plurality of tension members are not being used to suspend the panel.

An inflatable hammock pad comprises a panel with a plurality or network of fluid interconnected inflatable cells or regions provided by the panel. The cells or regions are in fluid communication with each other and provide an air cushioned top surface. A plurality of tension members are attached on both ends of the panel. Free ends of the tension members are configured to be attached to end points or structures and thereby suspend the panel. When the hammock is not being suspended for use, one or more locking structures may be used to confine or otherwise restrict movement of the plurality of tension members. Alternatively, a detachable structure may be used to detach the plurality of tension members from the panel which allows the panel to be used as a sleeping pad.

Figure 1:
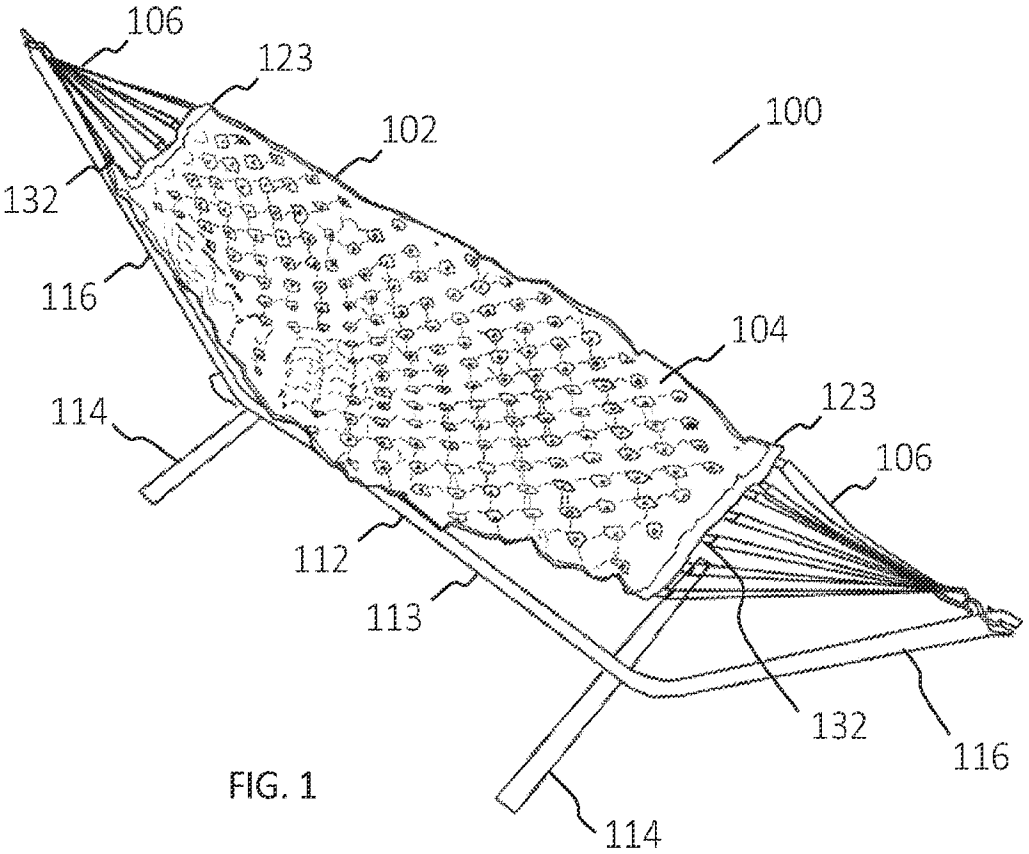
FIG. 1 is a perspective view of an inflatable panel used as a hammock.
Figure 3:
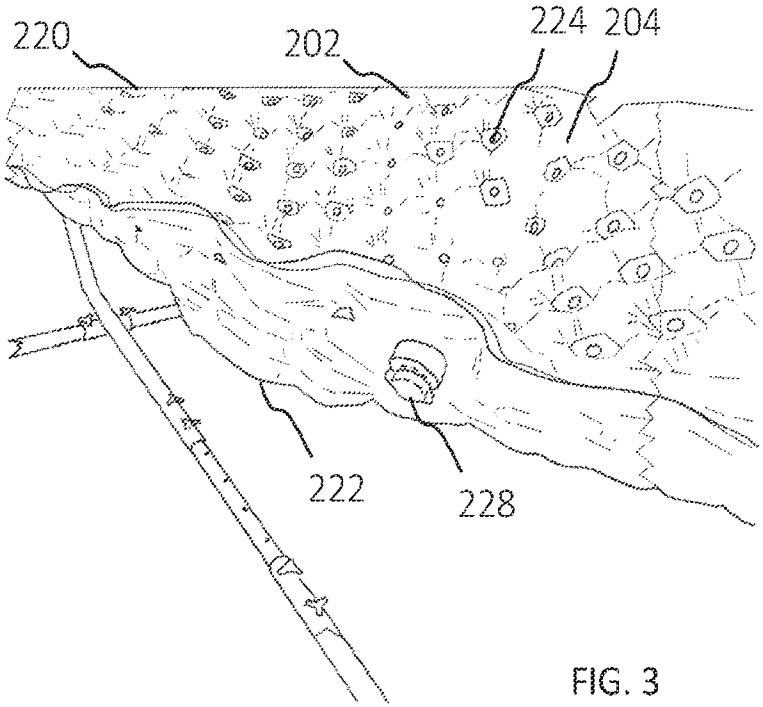
FIG. 3 is a perspective view of a portion of an inflatable panel used as a hammock.

Turning to FIG. 1, an example inflatable hammock 100 is shown. The hammock includes a generally flat panel 102. The flat panel includes a top ply and a bottom ply. This is shown in FIG. 3 as indicated by top ply 220 and bottom ply 222. Between the plies are regions that contain air 104 or other gas, being sealed by bonded portions, where the top and bottom plies are sealed together. Bonded portions 224 are indicated in FIG. 3. The bonded portions 224 where the plies are sealed together are configured with a pattern to provide the continuous sealed air containing region 104. The entirety of the air containing regions 104 are configured to be in air communication so that the entirety of the air containing regions 104 can be inflated or deflated together. At the ends of the panel 102 are attached a plurality of tension members 106. The tension members 106 include free ends that are configured to suspend the panel 102. The free ends may be attached to points, such as vertical stands, tree trunks, or other points that allow the panel to be suspended in air.

Figure 2:
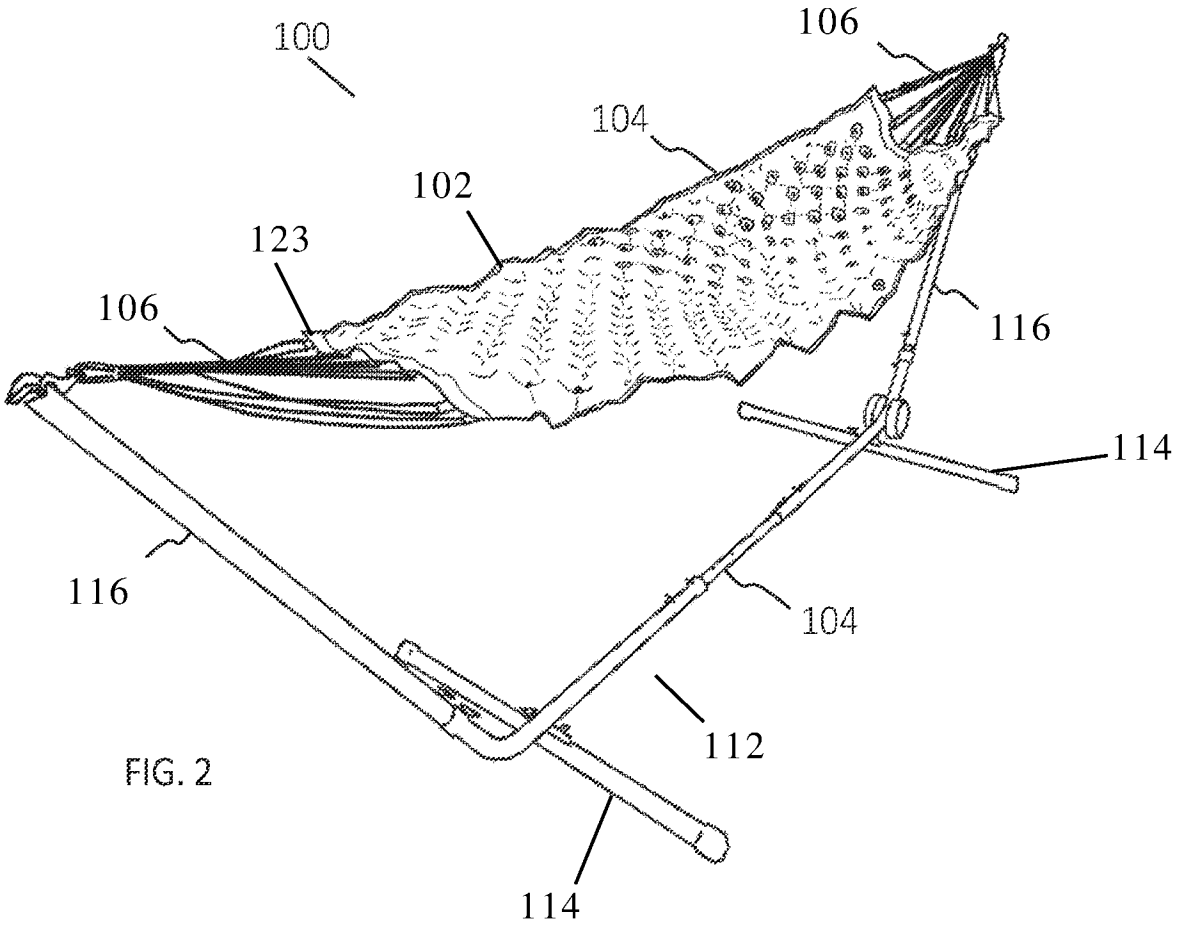
FIG. 2 is a perspective view of an inflatable panel used as a hammock.

As shown in FIGS. 1 and 2, an exemplary stand 112 with a base 114 and two outstretched arms 116 provide two points from which the panel 102 is suspended. The base 114 includes an elongate structure with two crossbars that are attached perpendicular to the elongate structure on opposite sides of the elongate structure. Outstretched arms 116 are angled outward and upward from ends of the elongate structure. The elongate structure may curve or bend to form outstretched arms or the arms may be attached separately to the elongate structure. The arms 116 provide ground clearance from vertical displacement of the hanging hammock. They also provide sufficient tautness to keep the hammock horizontally and vertically stretched. Other types of structures are known in the art and may be used to suspend the panel 102.

As shown, the panel 102 includes bonded ends, which are an extension of the bonded portions 224 (FIG. 3). The bonded ends may include a reinforcement member 123, such as a strip of fabric, plastic, resin, or other material, that is secured along each of the bonded ends. The reinforcement member may be located on top and bottom of the panel, or alternatively, on one side of the panel 102 only. Exemplary loops 132 are located at various points along the reinforcement member, such as equidistant spaced points shown. The loops 132 may alternatively be attached directly to the ends of the panel.

One or more tension members 106, or hammock support members are configured to pass through the loops 132 for suspending the hammock. Tension members 106 include elongate elements, such as ropes, straps, tethers, webbing, material used to support the panel 102 under tension when free ends of the tension members are attached to vertical supports or other points. Exemplary tension members as shown include tethers that attach at various points along either end of the panel. Particularly, the tension members pass through the loops and fold around so that both ends of the tension members are secured to vertical supports. The tension members 106 join at endpoints of the outstretched arms. The endpoints of the outstretched arms include a hook. Other types of endpoints include clasps, rings, fasteners, hooks, ties, or other structure of a point for attaching the endpoints of the tension members 106 and thereby suspending the panel 102.

Instead of loops, ends of tension members 106 may be attached to locking structures, ties, hooks, buckles, Velcro®, hook and loop fasteners, carabiners, snaps, or other structures. The loops or locking structures are configured to allow the tension members 106 to be released from the panel. Instead of loops, tension members 106 may attach directly to outer edges of the panel 102 or reinforcement members 123. Variations includes that tension members be attached such that they are not removable from the panel 102.

Turning to FIG. 3, the panel 202 as shown includes a top 220 and bottom 222 substrate that are bonded, sealed (e.g., heat, adhesive, friction, etc.), or otherwise attached together to form bonded or sealed regions 224 in a pattern that define the air containing region 204. For example, the bond may occur at or near outer edges of the panel. Within at least a portion of the area surrounded by the edges, the pattern of bonded areas defines the configuration of the air containing region 204 providing fluid or air-flow communication throughout the region. The bonded areas 224 may be patterned to provide air containing regions where the surface will support and comfort a user of the hammock or mattress configuration. The bonded area will suitably be provided for non-supporting portions.

The configuration of the bonded areas or regions 224 may entail one or more of elongated lines, straight lines, curved lines, jagged lines, or other types of lines. Furthermore, the bonded areas 224 may be any regional space configuration that defines the air containing regions 204. The bonded areas may define air containing regions that are tube-like, round, ball-like, oblong, egg-like, cubed, rectangular, ovoid, triangular, trapezoidal, and/or any number of shapes and sizes. The air containing regions may also being the form of a lattice pattern, a grill pattern, or any suitable repeating or random pattern. A pattern for the air containing regions may be random, or comprise similar repeating but different shapes. The configuration for the bonded areas and air containing regions may also be defined by a pattern to provide an omni-directional or a directional stiffness or other support property to a region of the panel. For example, it may be desirable to increase stiffness in a back support area, or to allow easier bending in a particular direction, such as at sides or a seat of hammock. The air containing area 204 formed by the bonded areas 224 may define a pattern with parallel lines or some other symmetrical pattern. The pattern shown is a symmetrical array formed by a crisscross pattern. Patterns of the bonded regions may have lines that are parallel or angled relative to an axis of the panel, and may contain patterns forming lines, squares, hexagonal shapes, staggered, shapes, or other suitable shapes. Lines may be curved, straight or defined in other ways.

Structures that function equivalently to the two-ply bonded construction are contemplated, such as, a single-ply material with air cells bonded to it, with communication of the air cells.

The panel may be any shape, including circular, rectangular, triangular, oval, and other shapes. Contours and Rounded edges may be added to provide certain stability and comfort as desired. For example, as shown in FIGS. 1 and 2, the panel is wider at its center than at its ends. The edges curve outward from the ends to the center. This provides a wide space and stability for the user at its center region.

The air containing region 204 includes a hollow space or fill volume as defined between the top 220 and bottom substrates 222 being bonded together or attached by structure. The bonded 224 regions and other regions have no fill volume or less of a fill volume. When used as a pad, at least a portion of the cells are configured to provide support to a user and elevate the user above a ground surface. Certain regions may be in the form of cells that have a greater fill volume than other cells to provide a primary support to target regions of the user, such as the hips and shoulders, or other body regions. Secondary support regions with less fill volume are configured to provide support to other regions, such as a neck, middle back, upper leg, and/or lower leg region. In this manner, cells vary to provide a desired contour for a typical body type of a user, or be tailored for a specific body type.

At least one or more valves may be provided at an air inflation port 228 as shown in FIG. 3 and coupled to the inflatable panel 202 and configured to allow fluid communication or air inflation to the air containing region. Particularly, illustrated in the figures is an inflatable hammock with one air containing region inflated through one valve. Valves 228 may also allow for certain or second air cells or regions to be inflated for use as a hammock, while other air cells or regions are inflated for use as a pad. There may be air regions 204 that are partitioned or otherwise closed off from each other so that valves are in communication with certain regions but not others. One valve may be configured for larger regions while another valve is configured for smaller regions. The valves shown may be located at or near edges of the panel, on top or bottom surfaces of the panel, and anywhere else that allows fluid communication to the cells. Alternatively, other structures may be used to allow fluid communication to the air containing regions. Inflation may be supported by structures that allow inflation at least partially by mouth. This may allow for the utilization of the low pressure capabilities of a person's lungs as well as a reasonably sized pump that can create the pressures that provide comfort and proper insulation within the panel without causing too much pressure that could compromise the material properties of the panel 202.

The top 220 and bottom plies, sheets, or substrates 222 may include different compositions. For example, the bottom substrate 222 may be a more dense, heavy material and/or have other properties to bear weight. Additionally, the material may include a more insulative material to bear weight and/or protect against the elements.

Plies may be any suitable air impermeable material, and may include one or more of woven fabric, impregnated resin, rubber membranes, flexible plastic or polymer sheets, and the like. The materials may include one or more of canvas, plastic, nylon, polyester, solution-dyed acrylic/olefin. The material may further include properties of durability, inflatability, and comfort. The plies or substrates may be of the same or a different material.

Figure 4:
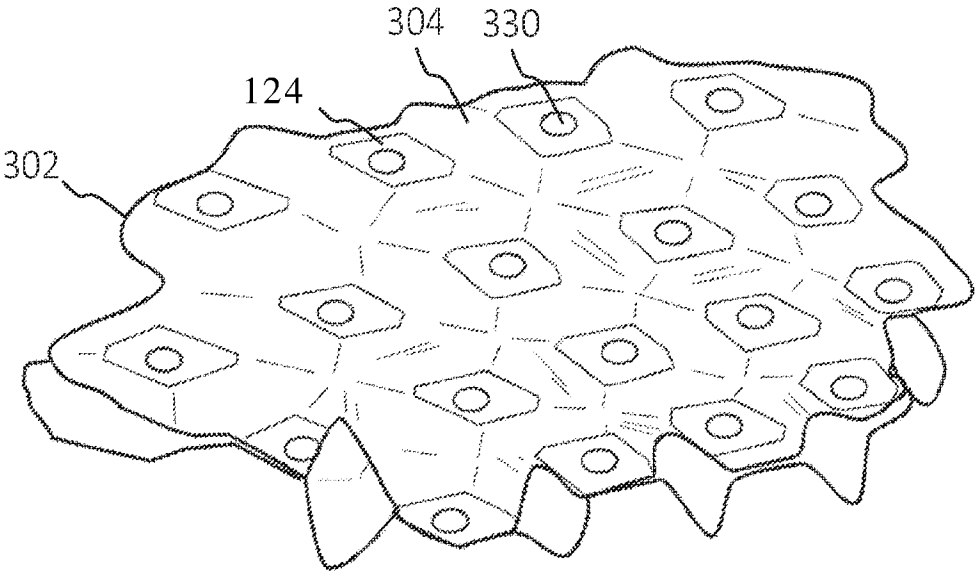
FIG. 4 is a close-up view of portion of an inflatable panel used as a hammock.

The panel may further include a plurality of holes 330 as shown in FIG. 4 that are configured with sufficient dimensions to allow rainwater and other fluids to pass through. The holes 330 may be located anywhere on the panel 302. For example, the holes may be located on the bond areas that are in between cells. Not only do the holes 330 allow rain to drain out of the hammock during rainy weather, but the holes 330 are also beneficial because they allow air to flow to keep a user cool in warm weather. Holes 330 may be strategically located anywhere on the panel to provide optimal water drainage.

Figure 5:
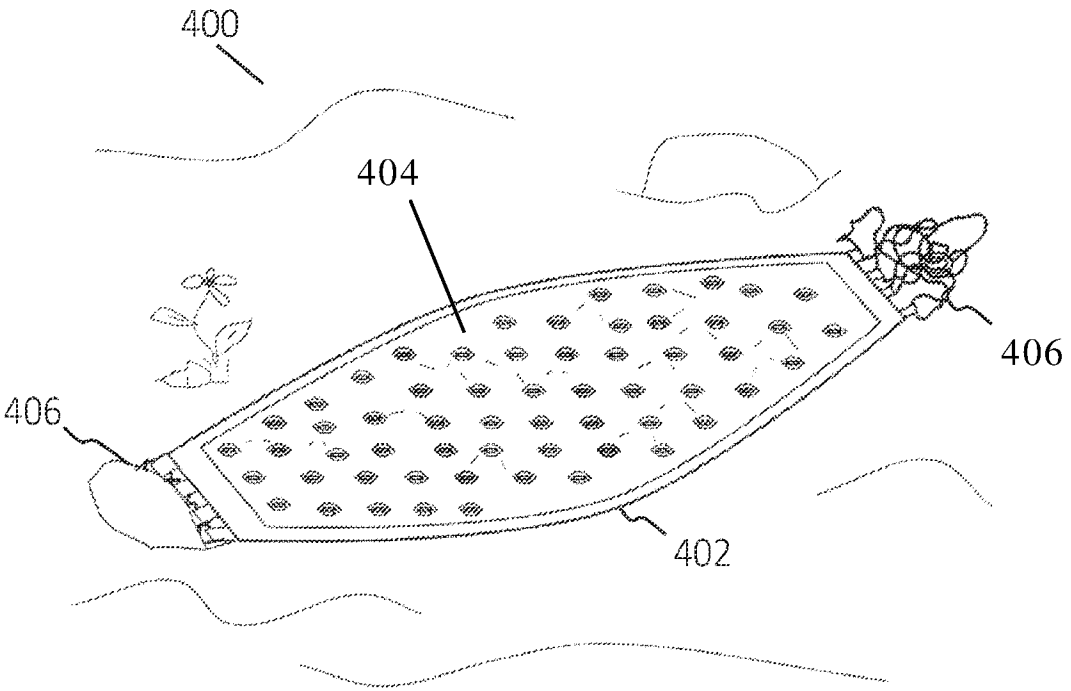
FIG. 5 is a perspective view an inflatable panel used as a sleeping pad.

When the panel is not being suspended by the tension members, the panel may find further use as a pad on the ground or other surface as shown in FIG. 5. For example, the panel 402 serving as a pad provides suitable support or padding for a user to lay down and sleep or rest. Because the panel 402 provides inflated cells 404 that support and elevate the panel 402 above the ground, the panel 402 may provide additional protection from rocks, roots, and other objects that might otherwise cause discomfort to the sleeper. The panel 402 no longer has curvature from being suspended by tension members 406, but rather has a neutral position that is generally horizontal so that it lays flush with a ground surface. Alternatively, the panel 402 may retain some curvature either on a top surface or bottom surface or both surfaces. Either way, the panel 402 is structured to provide support through the inflated cells 404 to a user while being suspended or while being on a ground surface.

An exemplary inflatable hammock can be used as a standalone device. Alternatively, the panel from a hammock can be configured to be used as a sleeping pad. For example, tension members can be detached from the panel. The reinforcement member, or material at the end of the panel can be removed, for example, with a zipper, snaps, or other locking structure. Alternatively, the straps can be removed from the loops. Other means of attachment discussed herein can be used for removal as well.

Figure 6:
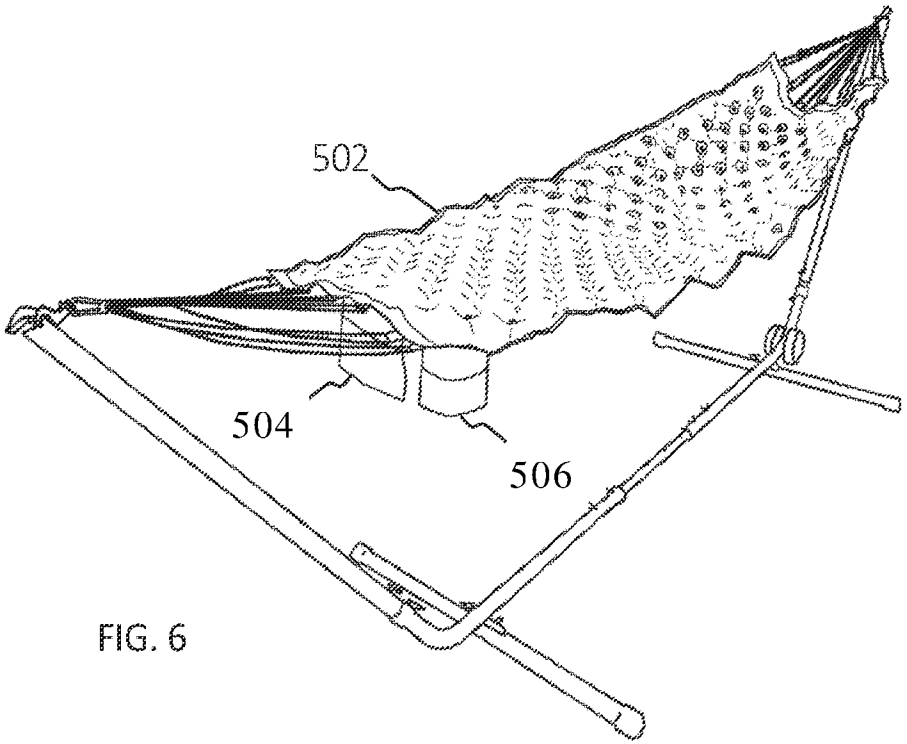
FIG. 6 is a perspective view an inflatable panel used as a hammock and that includes two exemplary pockets.

Instead of being removable, or in addition to being removable, the tension members can be tucked away and secured in a pocket 504 or 506 as shown in FIG. 6, or secured in some other way such that the tension members are out of the way and allow the panel 502 to be used in the same or similar manner as a regular pad that is designed to be used solely as a pad. Exemplary pockets 504 is shown attached to the end of the panel, whereas pocket 506 is shown attached to corner. Various attachments are anticipated. Furthermore, each end of the panel 502 may include a pocket 504 and/or 506 in which the tension members associated with the same end of the panel can be stored.

Exemplary tension members may be stored on or within the pad itself, whether the tension members are removable or not. For example, a locking structure may secure a tension member to the panel when not in use. The locking structure could include clasps, rings, fasteners, hooks, ties, hooks, buckles, Velcro, hook and loop fasteners, carabiners, snaps, or other structures.

The panel may further have a housing structure for securing the tension member. The housing structure may be casing element that includes a compartment, or fold within the panel that is structured to house a corresponding tension member. The casing element may be a pocket that includes an opening or compartment that is dimensioned to hold the tension members. The pocket may be removable or non-removable. The pocket can be attached to the hammock, for example, at an end of the hammock. A pocket would include an opening or compartment that was dimensioned to hold the tension members when the tension members are not in use.

The casing element may further include a closure structure that at least partially closes an opening of the casing to seal off the tension members when the tension members are not in use with the panel and thereby house the tension members. For example, the casing element may include ties, zippers, snaps, or other locking structures discussed herein that may be used to close off the casing element to confine the tension members or close off the tension members within the pocket.

Figure 7A:
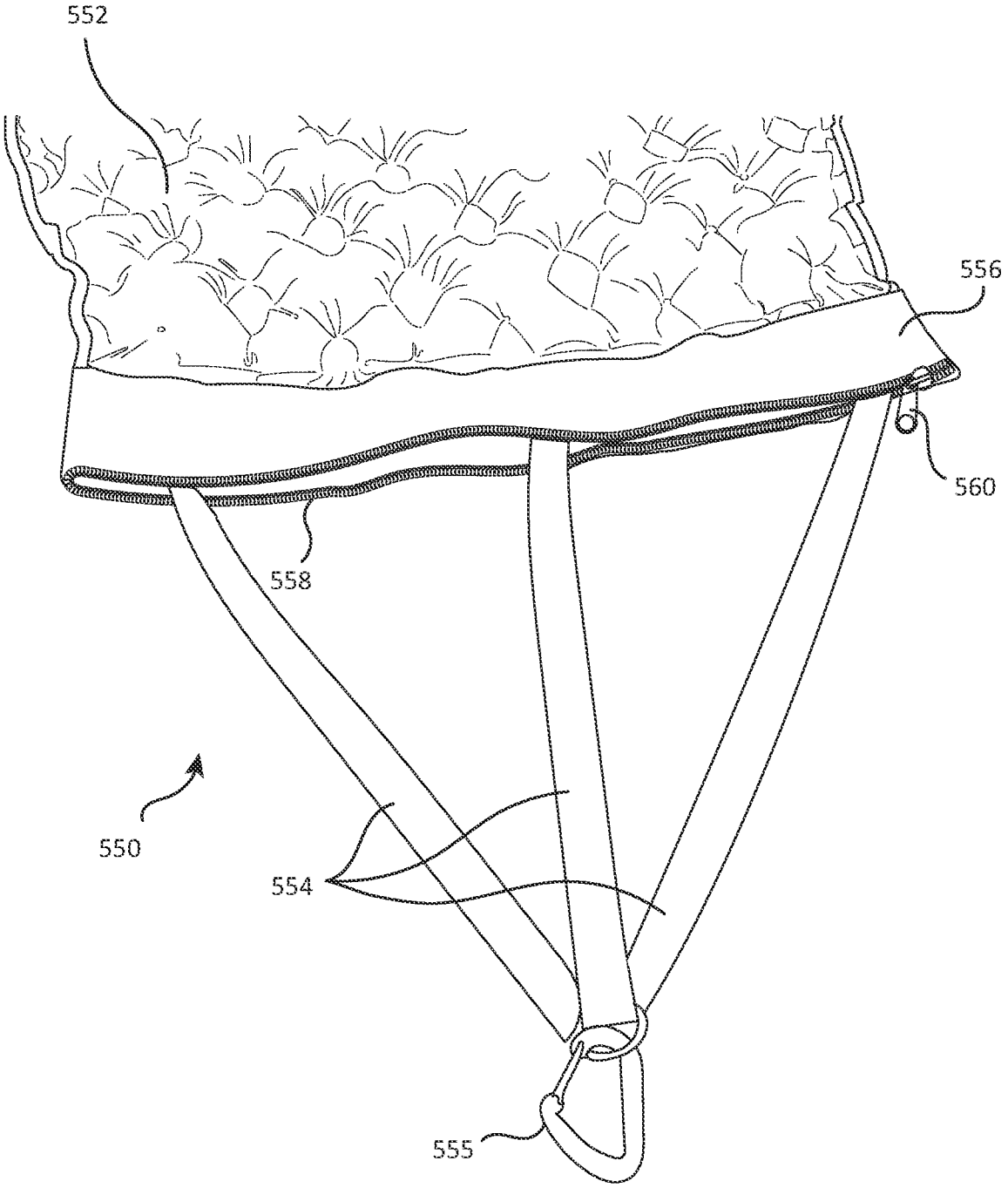
FIGS. 7A and 7B illustrate a first end of a hammock pad with a tension member compartment.
Figure 7B:
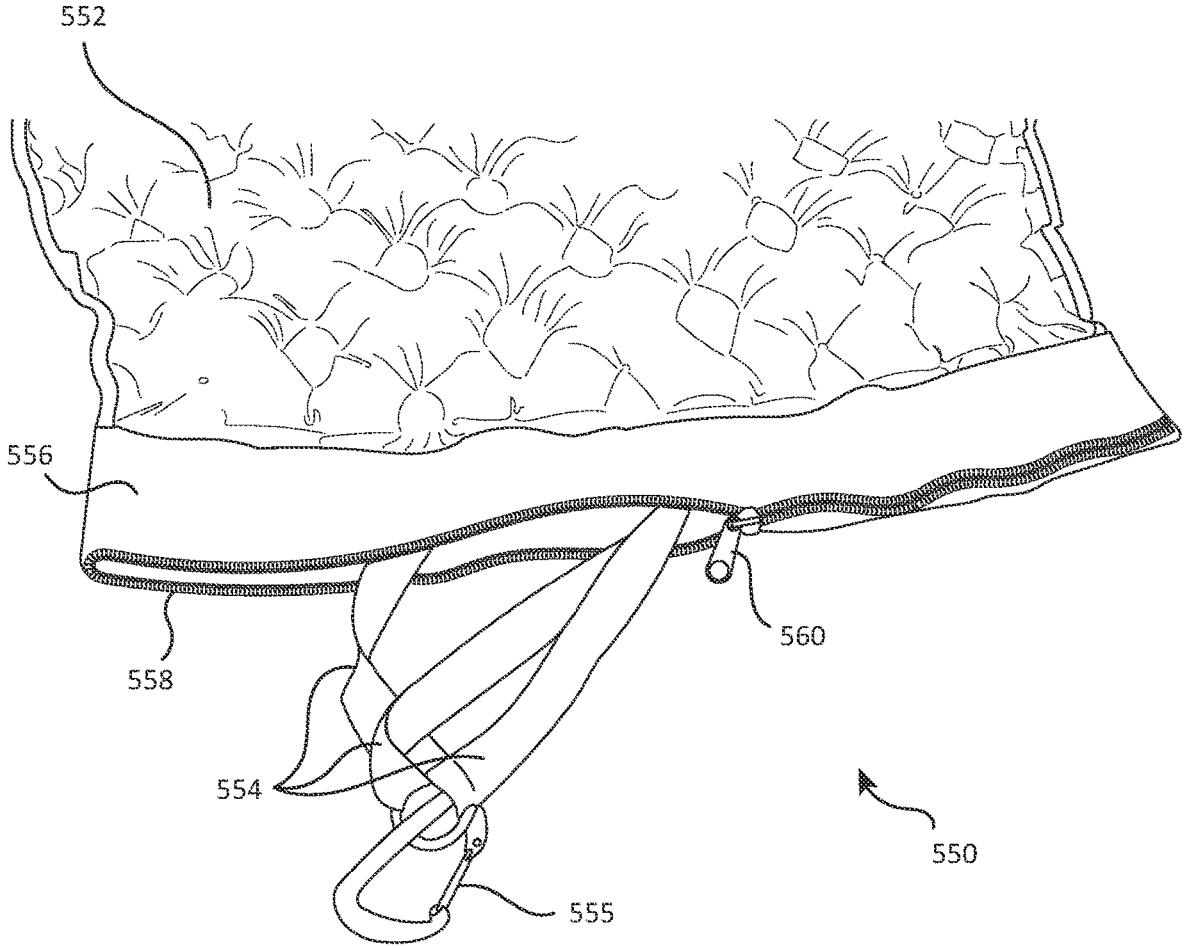

FIGS. 7A and 7B illustrate an end of a hammock 550. It will be appreciated that an opposing end of the hammock 550 may be similar or identical to the illustrated end. The hammock 550 may include features that are similar to or the same as the other hammocks disclosed herein.

The hammock 550 includes a pad 552 that is configured to support a user thereon. Similar to the other embodiments disclosed herein, the pad 552 may be selectively inflatable (e.g., through a valve). Likewise, the pad 552 may be used as a ground pad. Additionally or alternatively, the pad 550 may be suspended from one or more supports for use as a hammock. For instance, each end of the hammock 550 may include one or more tension members 554 configured for connecting the pad 552 to one or more supports (e.g., frames, trees, etc.) to suspend the pad 552 above the ground. In the illustrated embodiment, the one or more tension members 554 comprise three tension members. One of the tension members 554 is connected to an end of the pad 552 adjacent a first side of the pad 552, a second tension member 554 is connected the end of the pad 552 adjacent a second side of the pad 552, and a third tension member 554 is connected to the end of the pad 552 adjacent to a midway point between the first and second sides of the pad 552. The opposing or free ends of the tension members 554 can be connected to a connector 555 (e.g., clip, hook, etc.) that is configured to connect to a support element (e.g., frame, tree, etc.)

In the illustrated embodiment, the tension members 554 are connected directly or indirectly to the ends of the pad 552. For instance, ends of the tension members 554 may be sewn, clipped, zipped, glued, or tied to the ends of the pad 552. As disclosed herein, the connections between the tension members 554 and the ends of the pad 552 may be permanent or selectively connectable/removable.

The hammock 550 may also include a compartment 556 at each end of the pad 552 or at one end of the pad 552. Each compartment 556 may be integrally formed with or connected to an end of the pad 552. For instance, the material that forms the pad 552 may also form the compartment(s) 556. Alternatively, the compartment(s) 556 may be formed separately from the pad 552 and then attached to the end(s) of the pad 552. Still further, the compartment(s) 556 may be formed by attaching material to the end(s) of the pad 552 to form the compartment(s) 556. In some embodiments, the compartment(s) 556 are selectively connected to and disconnectable from the pad 552.

In the illustrated embodiment, a piece of material is attached to the end of the pad 552. The piece of material is folded so as to form opposing surfaces of the compartment 556. The opposing surfaces of the compartment 556 define an opening 558 into an interior space within the compartment 556. As illustrated in FIG. 7B, the interior space within the compartment 556 is sized to receive the tension members 554 therein. The compartment 556 also has a closure mechanism 560 (e.g., zipper, ties, hook and loop fasteners, etc.) that is configured to at least partially close the opening 558 into the interior space 558 of the compartment 556 to retain the tension members 554 therein. The closure mechanism 560 may extend along an entire width of the compartment 556 or a portion thereof. Thus, when the pad 552 is not suspended from a support element (e.g., frame, tree, etc.), the tension members 554 can be disposed and retained within interior space of the compartment(s) 556.

As illustrated in FIG. 7A, the opening 558 of the compartment 556 opens away from the pad 552. The tension members 554 are configured to extend out of the interior space of the compartment 556 through the opening 558 while remaining attached to the first end of the pad 552. The tension members 554 can extend out of the compartment 556 to connect to a support in order to suspend the pad 552 therefrom. The connection point(s) between the ends of the tension members 554 and the pad 552 may be entirely or at least partially enclosed within or concealed by the compartment 556. In some embodiments, the tension members 554 and the compartment 556 are connected to the end of the pad 552 using the same or common connector. For instance, the tension members 554 and the compartment 556 may be sewn to the end of the pad 552 at the same time and with the same thread. In other embodiments, the ends of the tension members 554 may be indirectly connected to the end of the pad 552. For instance, the ends of the tension members 554 may be connected directly to an interior surface of the compartment 556 and the compartment 556 may, in turn, be connected to an end of the pad 552.

As illustrated, the compartment 556 extends across the entire width of the end of the pad 552. In other embodiments, the compartment 556 may extend across only a portion of the width of the end of the pad 552. Furthermore, as shown, the compartment 556 may have a width (extending in the same direction as the width of the pad 552) that is substantially larger than a length thereof. For instance, the width of the compartment 556 may be multiple times (e.g., two, four, five, or ten) longer than the length thereof.

Figure 9:
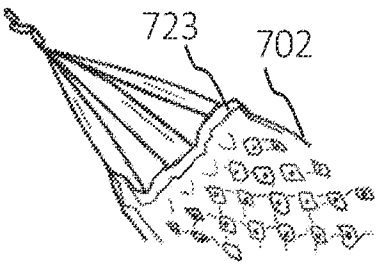
FIG. 9 is a perspective view of a portion of an inflatable panel used as a hammock.
Figure 8:
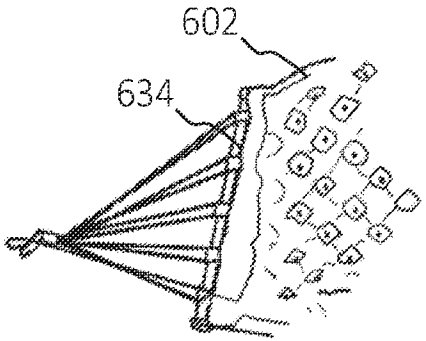
FIG. 8 is a perspective view of a portion of an inflatable panel used as a hammock.

A spreader bar 634 may be included at or near the ends of the panel 602 to maintain the panel in an outspread position, as shown in FIG. 8. The bar 634 may be permanent or removable. A spreader bar 634 is an elongate structure that may be a rod or other elongate element that slidably engages, attaches, or otherwise is connected to the end of a panel. The spreader bar 634 may comprise one or more bars that interlock and that may be detached for storage when the hammock is not in use or for transportation purposes. FIG. 9 illustrates a flexible end 723 of the panel 702 in contrast to a rigid end for a panel 602 in FIG. 8.

The panel may include a channel, for example, a channel formed by bond lines between the top and bottom substrates, through which a spreader bar 634 may be slidably engaged. Alternatively, ends of the panel may be folded over to form a channel. Other attachments besides spreader bars are also anticipated.

Instead of one panel, multiple panels may be used to form the hammock. The multiple panels may be detachable to make the hammock conform to a desired a shape, contour, or other design.

Instead of a plurality of tension members at each end, only one tension member may be used at one or both ends. The panel may have loops in which one or more tension members is threaded. The hammock may further have tensioning members and structures around the entire panel or at least a portion of the panel. Tension members may be interlocking around the panel to form a hanging cocoon-like structure. Hangers may be used to suspend the panel at various points as well. A variety of tensioning structures and principles may be used to incorporate the inflatable elements discussed herein.

Figure 10:
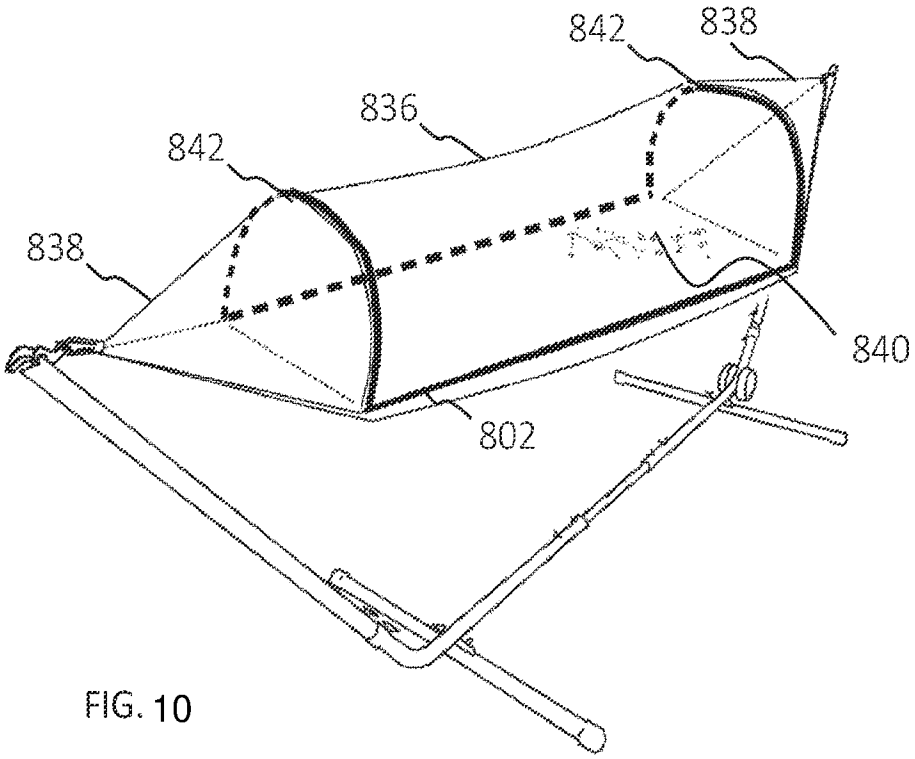
FIG. 10 is a perspective view of an inflatable panel used as a hammock and that includes a tent structure.

FIG. 10 illustrates an exemplary tentlike structure 836 that is used for an inflatable hammock. The tentlike structure 836 may include netting 840 (a representative portion is shown) that surrounds the panel 802 and that is configured to shield a user from mosquitos and other animal life that may be in the vicinity. The shield may be of a material to offer protection from weather, such as rain and wind and debris, such as falling leaves. The netting/cloth structure shown includes one or a plurality of wire supports 842. The supports are rounded, but they may have straight lines as well. Ends of the supports are located at or near outer edges of the hammock, but they may be located elsewhere. As shown, two supports 842 are located at ends of the hammock with free ends attached or located at outer edges of the hammock. Zippers, ties, Velcro®, hook and loop, buttons, and other structure may be used to secure the tentlike structure to the hammock. At shown, an additional tether 838 starting from either end of the tension members to a top of the tentlike structure 836 is used to secure the tentlike structure to the hammock.

Figure 11:
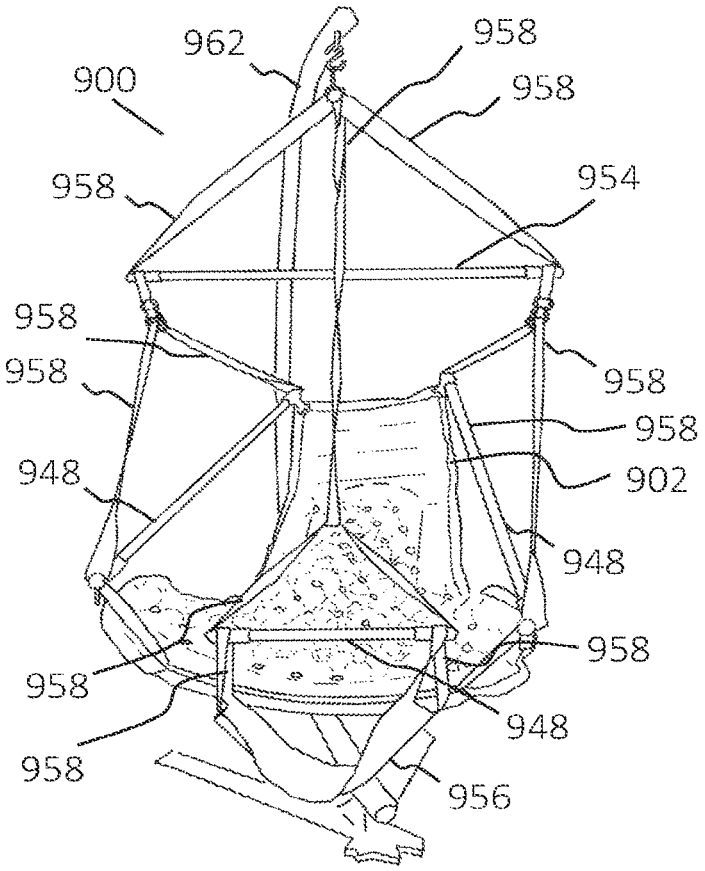
FIG. 11 is a perspective view of an inflatable panel used as a hanging chair.

FIG. 11 illustrates an alternative configuration for the inflatable panel, namely, as a chair structure 900. The exemplary chair structure includes a panel 902 that is supported by side bars 948 that attach to opposing corners of the panel 902. Various straps 958 are used to suspend the panel 902. As shown, straps 958 are secured to endpoints of the side bars 948. A top bar 954 above the chair structure is attached to endpoints of the straps 958 and endpoints of the top bar 954 have straps 958 which are attached at endpoints to a fixed point of a support structure. The chair may further include a footrest 956, an elongate flat fabric or inflatable foot panel, the footrest 956 being attached by straps 958 to a footrest support bar 948. Ends of the footrest support bar 948 are attached by straps 958 to a vertically oriented strap 958 that connects to the fixed point of the support structure 962.

As shown in FIG. 11, the air containing region 904 extends almost entirely over the back of the chair. The only bonded regions 925 at the center the back are in the form of linear lines 990 that provide a direction stiffness across the back while retaining up and down flexibility.

It is anticipated that the support structure 962 for a hanging chair configuration may be a vertical bar that curves outward and slightly horizontally, as shown. The support structure may further include a support base, such as horizontally extending bars that connect to the vertical bar. Other types of support structures may be used, however, that allow a chair to be suspended in air above ground level and that are configured to provide sufficient clearance to allow the chair to hover over the ground surface below and freely swing in the air.

If is further anticipated that the panel shape of the chair be the same as the panels previously described. Panel shapes for the chair may further include shapes that are narrower on one end and wider and/or flared outward on an opposing end to provide comfort and suitable support of a chair.

While straps and bars have been described in support of the figure shown in FIG. 11, straps and bars may vary in number and attachment to suspend a chair.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A hammock comprising:

an elongated pad configured to support a user thereon, the elongate pad having a first end and an opposing a second end;

a compartment permanently attached to or integrally formed with the first end of the pad, the compartment comprising an interior space separate from the elongate pad and an opening to the interior space located distally from the elongated pad; and one or more tension members attached to the first end of the pad or an interior surface of the compartment, the one or more tension members being configured to selectively extend out of the compartment through the opening therein and to be selectively disposed within the interior space in the compartment, wherein the compartment is configured to enclose or conceal attachment points between the one or more tension member and either the first end of the pad or an interior surface of the compartment when the one or more tension members are selectively disposed within the interior space and when the one or more tension members are selectively extended out of the interior space to suspend the elongated panel.

2. The hammock of claim 1, wherein the pad is selectively inflatable.

3. The hammock of claim 1, wherein the compartment comprises a closure mechanism that is configured to selectively close the opening in the compartment.

4. The hammock of claim 1, wherein the one or more tension members comprise a first tension member attached to the first end of the pad adjacent a first side of the pad and a second tension member attached to the first end of the pad adjacent to a second side of the pad.

5. The hammock of claim 1, further comprising a second compartment permanently attached to or integrally formed with the second end of the pad, the second compartment comprising an interior space and an opening to the interior space.

6. The hammock of claim 5, further comprising one or more tension members attached to the second end of the pad or an interior surface of the second compartment, the one or more tension members being configured to selectively extend out of the second compartment through the opening therein and to be selectively disposed within the interior space in the second compartment.

7. The hammock of claim 6, wherein the second compartment encloses or conceals attachment points between the one or more tension members and the second end of the pad.

8. The hammock of claim 1, wherein the compartment comprises at most one opening through which the one or more tension members can be inserted into or removed from the compartment.

9. An inflatable hammock comprising:

an elongated pad configured to support a user thereon, the elongate pad having a first end and an opposing a second end, the elongate pad being selectively inflatable;

a first compartment permanently attached to or integrally formed with the first end and a second compartment attached to or integrally formed with the second end of the pad, each of the first and second compartments comprising an interior space separate from the elongated pad and an opening to the interior space located away from the elongated pad; and first and second sets of tension members attached to each of the first end and the second end of the pad or an interior surface of the first or second compartment associated with the first end or the second end of the pad, the one or more tension members being configured to selectively extend out of the associated first or second compartment through the opening therein and to be selectively disposed within the interior space in the associated first or second compartment, wherein the first compartment is configured to enclose or conceal attachment points between the first set of tension members and either the first end of the pad or an interior surface of the first compartment when the first set of tension members are selectively disposed within the interior space of the first compartment and when the first set of tension members are selectively extended out of the interior space of the first compartment to suspend the elongated panel; and wherein the second compartment is configured to enclose or conceal attachment points between the second set of tension members and either the second end of the pad or an interior surface of the second compartment when the second set of tension members are selectively disposed within the interior space of the second compartment and when the second set of tension members are selectively extended out of the interior space of the second compartment to suspend the elongated panel.

10. The hammock of claim 9, wherein the first and second compartments extend along an entire width of the associated first end or second end of the pad.

11. The hammock of claim 9, wherein each of the first and second compartments has a width that is multiple times as long a length thereof.

12. The hammock of claim 9, where each of the first and second compartments comprises a closure mechanism configured to close the opening to the interior space.

13. A hammock comprising:

an elongated pad configured to support a user thereon, the elongate pad having a first end and an opposing a second end;

one or more tension members attached to the first end of the pad at one or more attachment points, the one or more tension members being configured to selectively suspend the pad from a support element; and a compartment permanently attached to or integrally formed with the first end of the pad, the compartment comprising an interior space separate from the elongate pad and an opening to the interior space located distally from the elongated pad, the compartment at least partially enclosing or concealing the one or more attachment points between the one or more tension members and either the first end of the pad or an interior surface of the compartment when the one or more tension members are selectively disposed within the interior space and when the one or more tension members are selectively extended out of the interior space to suspend the elongated panel, the interior space within the compartment being sized to selectively contain the one or more tension members therein, and the opening to the interior space comprising at most one opening through which the one or more tension members can be inserted into or removed from the compartment, the at most one opening being sized to enable the one or more tension members to selectively extend out of the compartment through the at most one opening.

14. The hammock of claim 13, wherein the elongated pad is selectively inflatable.

15. The hammock of claim 13, wherein the one or more tension members are configured to selectively extend out of the compartment through the opening while remaining attached to the first end of the pad.

16. The hammock of claim 13, wherein the compartment extends across an entire width of the first end of the pad.

17. The hammock of claim 13, wherein the opening opens away from the pad and comprises a closure mechanism.

* * * * *